United States Patent [19]

Bullivant

[11] Patent Number: 4,834,582

[45] Date of Patent: May 30, 1989

[54] METHODS FOR UNDERPINNING UNSTABLE STRUCTURES

[75] Inventor: Roger A. Bullivant, Newton Solney, England

[73] Assignee: Roger Bullivant of Texas, Inc., Grand Prairie, Tex.

[21] Appl. No.: 3,731

[22] Filed: Jan. 16, 1987

[30] Foreign Application Priority Data

| | | | |
|---|---|---|---|
| Jan. 16, 1986 | [GB] | United Kingdom | 8601044 |
| Mar. 20, 1986 | [GB] | United Kingdom | 8606942 |
| Sep. 2, 1986 | [GB] | United Kingdom | 8621184 |

[51] Int. Cl.[4] ..... E02D 27/48; E02D 5/34; E02D 5/00

[52] U.S. Cl. ..... 405/230; 405/233; 405/244

[58] Field of Search ..... 405/229, 230, 244, 272, 405/233

[56] References Cited

U.S. PATENT DOCUMENTS

| | | | |
|---|---|---|---|
| 1,451,799 | 4/1923 | Youngblood | 405/230 |
| 2,378,995 | 6/1945 | Freeman | 405/230 |
| 4,548,526 | 10/1985 | Bullivant | 405/230 X |
| 4,659,256 | 4/1987 | Bullivant | 405/230 |
| 4,678,373 | 7/1987 | Langenbach | 405/230 |

FOREIGN PATENT DOCUMENTS

| | | | |
|---|---|---|---|
| 2047303 | 11/1980 | United Kingdom | 405/230 |
| 2068038 | 8/1981 | United Kingdom | 405/230 |
| 2094380 | 9/1982 | United Kingdom . | |

OTHER PUBLICATIONS

"Underpinning the Cross Building, " *Engineering News,* Dec. 19, 1912, p. 1134.

*Primary Examiner*—Dennis L. Taylor
*Assistant Examiner*—John Ricci
*Attorney, Agent, or Firm*—Richards, Harris, Medlock & Andrews

[57] ABSTRACT

Several underpinning arrangements are described. In each, a concrete pile is cast in a hole formed adjacent to the structure to be underpinned. The hole is formed from at or near ground level and is vertical or at an angle close to the vertical. At least one supporting limb is also formed. This extends from the pile hole and engages the structure. When the pile is cast in the pile hole, the pile and supporting limb are made to form a unitary element so that forces exerted on the supporting limb by the structures are transmitted to and borne by the pile. Various configurations of supporting limb are described, as are various arrangements for ensuring that the supporting limb is retained in a position in which it supports the structure. A drilling assembly for use in the method is also described.

18 Claims, 3 Drawing Sheets

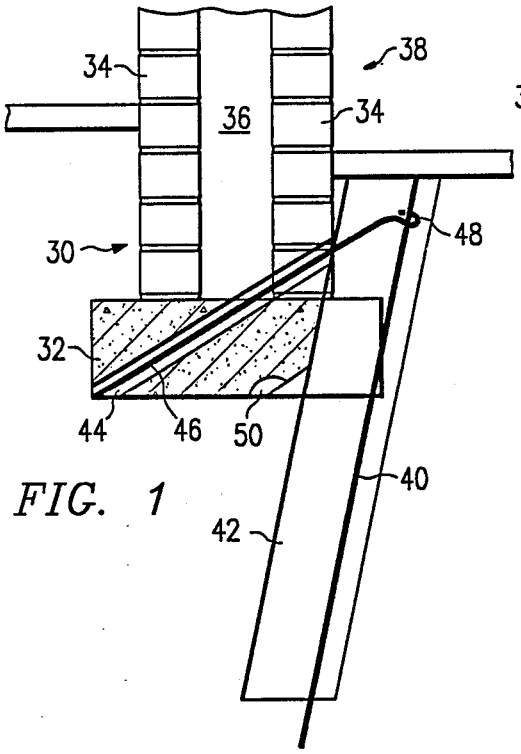
FIG. 1
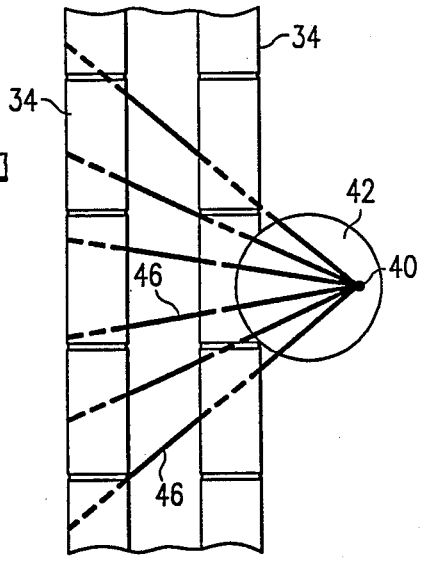
FIG. 2
FIG. 6
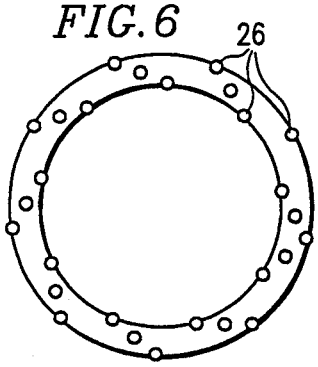
FIG. 7
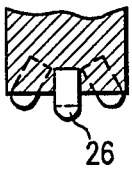
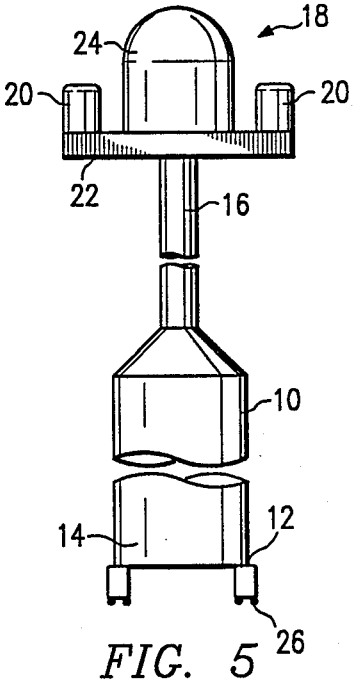
FIG. 5

METHODS FOR UNDERPINNING UNSTABLE STRUCTURES

The present invention concerns methods and apparatus for underpinning unstable structures, including non-rigid structures.

In many instances buildings become unstable because of subsidence of the ground supporting the foundations. A further problem occurs if the structure is not in itself rigid. This often occurs when the building was constructed in the period prior to the introduction of concrete foundations.

According to the present invention there is provided a method of underpinning a structure, comprising forming a hole adjacent to the structure, in which hole a concrete pile may be cast, the hole being formed from at or near ground level and being vertical or at an angle close to the vertical, forming at least one supporting limb which extends from the pile hole and engages the structure, and casting a pile in the pile hole, the pile and supporting limb being so made as to form a unitary element, whereby forces exerted on the supporting limb by the structure are transmitted to and borne by the pile.

In a first preferred arrangement, at least part of the pile hole is formed through the structure, at least one longitudinally extending reinforcing member is located in the pile hole, and a supporting limb or limbs are formed by fixing ties to the structure and to said reinforcing member, the reinforcing member and ties being located and fixed before the pile is cast.

Preferably the reinforcing bar is located off centre in the hole.

Preferably the ties radiate outwardly and downwardly from the reinforcing bar. The ties may be located in hole drilled in the structure and fixed therein by grout. The ties may be hooked around the reinforcing bar.

Preferably the hole is formed by removing a core. The core preferably includes a segment of the structure.

Preferably the hole is formed from outside the structure but may, if circumstances dictate, be formed from inside the structure.

Preferably a plurality of holes are formed at spaced intervals around the structure, each having a pile with projecting ties fixed to the structure.

A beam may be fixed to the pile tops to form a ring beam around the structure. Shear pins may project from the beam into the structure. The beam may be formed in situ.

In an alternative method according to the invention, a pile hole is formed at an angle close to the vertical, at least part of the hole being formed through the structure, and thereafter a drilling technique is utilised to cut a slot through the structure, the slot opening out on the underside of the structure and being formed from within said hole and a pile is formed in the hole, the pile formation including the step of providing an integral step in said slot.

Preferably the upper end of the slot lies at an angle as close to horizontal as the drilling conditions allow.

Preferably the pile is formed by pouring concrete into the pile and slot.

Preferably reinforcement is placed in the hole prior to the pouring of concrete. The reinforcement may extend to the slot.

Preferably the hole is formed by a drilling assembly of the type disclosed herein.

Preferably the slot is formed by a small diameter rotary percussive drill which is mounted on a structure which originally supported the hole forming drill.

A further alternative method according to the present invention includes placing or forming the pile alongside the structure to be supported, with the upper regions of the pile contacting a side of the structure, drilling a downwardly extending hole into the structure at an angle to the horizontal and vertical in the region of said area of contact, locating at least one reinforcing member in said hole, connecting said member with the pile and thereafter filling the hole with cementitious material.

Preferably the pile has a diameter greater than the diameter of the hole drilled in the structure and may be formed by the coring method described below. Alternatively the pile may be formed by driving a hollow casing and thereafter filling the casing with reinforcing members and concrete.

The pile casing may be of plastics materials and may have a steel tip. The pile may be of the type disclosed in either of our UK patent application Nos. 8601195 or 8608823.

Alternatively the pile may be a solid pile which is top driven.

Contact between the top of the pile and the structure to be supported may be provided by removing a segment from the side of the structure in which part of the pile periphery is accommodated.

According to a further aspect of the present invention there is provided a drilling assembly comprising a cylindrical drill bit open at one of its ends, said end being provided with a plurality of buttons of a material relatively harder than the material of the cylinder, the other end being connected to drive means adapted to apply rotational and reciprocal percussive forces to the bit.

The term "button" used herein is primarily intended to mean an insert having a substantially hemispherical end. The button may have a "chisel" configuration but this is less preferable.

Various underpinning arrangements according to present invention will now be described by way of example only and with reference to the accompanying drawings, in which:

FIG. 1 shows a sectional elevation of a building structure underpinned by a first arrangement;

FIG. 2 shows a diagrammatic plane of the structure shown in FIG. 1;

FIG. 5 shows diagrammatically a rotary percussive drilling assembly for use in the method;

FIG. 6 shows an end view of the lower face of the drill bit of the assembly;

FIG. 7 shows a cross-section through the drill bit;

Figure 3:
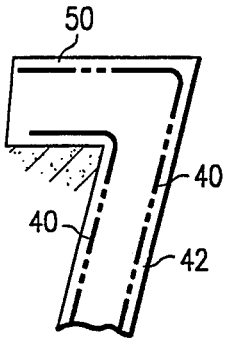
FIGS. 3 and 4 show diagrammatically sectional elevation and plan views of a modified underpinning structure.

A drilling assembly of the type illustrated in FIGS. 5 to 7 is utilised in a method intended to provide support for a structure 30 which comprises a foundation or footing 32 supporting a double thickness brick wall 34 having a cavity 36. The drilling assembly is located on the outside 38 of the structure and is set at an angle close to the vertical, that is within 10° of the vertical, and caused to drill downwardly such that it drills out a core including a sector of one of the brick walls 34 and of the footing 32. The bit is removed periodically to remove the core it has drilled and when a desired pre-calculated depth has been reached it is withdrawn and at least one reinforcing rod 40 is located in the hole at a position which does not coincide with the centre of the hole. The hole may be kept open by applying compressed air thereto until it is subsequently filled. It may also be held open by the use of tubular casings.

A smaller drilling assembly, which may be handheld, is utilised to drill a plurality of relatively small diameter holes through the brick wall 34 and footing 32, the holes radiating outwardly and downwardly from the centre of the reinforcing bar 40.

Galvanised small diameter steel ties 46 (of approximately ½ inch (12.7 mm) diameter) are then located in the small diameter holes 44 and permanently fixed therein by a cement and water grout. The ties 46 are deformed at their upper ends to provide hooks 48 which fit around the reinforcing rod 40, as can be seen from FIG. 1 and thereafter concrete is poured into a hole to provide a permanent reinforced concrete pile 42 with ties projecting therefrom.

It will be realised on considering FIG. 1 that the footing 32 is effectively cantilevered from the main pile 42, the ties 46 supporting the footing 32 over those areas of the structure not in the immediate vicinity of the pile.

Figure 4:
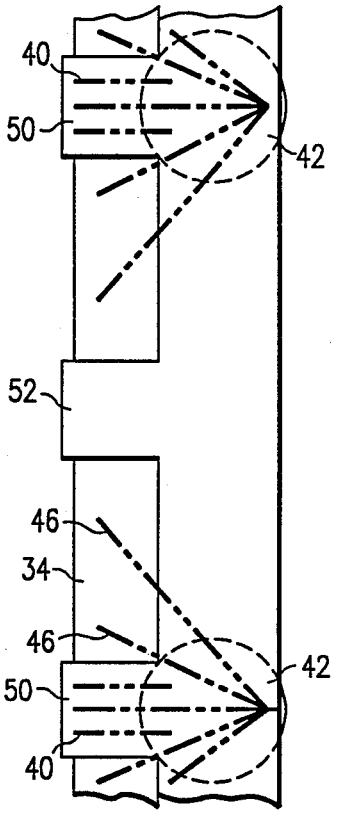

It has been found when forming the hole 44 that as the drill bit penetrates the lower face of the footing 32 the edge of the arc formed by the hole breaks away, as shown in FIG. 4 by the reference numeral 50, and when concrete is poured to form the main pile it occupies the region formed by the shoulder 50 to provide a ledge on which the foundation may rest.

The position of the reinforcing bar 40 is carefully calculated in the light of the bending moments to which the pile is subjected by the structure bearing on it and by the ties such that it is the most advantageous position to resist these loads.

A plurality of piles of the type described above can be located round the outside of a building. They need not be located particularly closely together as the ties 46 transmit load to the pile from areas relatively remote from it.

Various modifications can be made to this arrangement without departing from the scope of the invention, for the example the piles can be formed from inside the structure to be supported or from inside and outside depending upon the conditions encountered etc.

Where an old structure, that is a structure not having a footing 32, is to be supported a modified arrangement is employed. The steps described above are carried out as before but to provide better support for the areas of the structure intermediate the piles a ring beam is cast round the exterior or interior of the building resting on the top of and fixed to the piles. At intervals along the length of the ring beam the reinforcement therein supports shear bars which project laterally out of the beam into cavities formed in the structure, for example by removing bricks, to support the structure intermediate the piles.

FIGS. 3 and 4 show a modification of the structure described in the preceding paragraph. The top of each pile 42 is provided with a laterally projecting knuckle 50 formed as a continuation of the pile and having suitable reinforcement rods 40 therein. The knuckle projects into apertures formed through the wall of the structure to be supported or through the footings of the structure if such are present. A ring beam 52 is cast on top of the piles and extends around the periphery of the building, in this instance inside it. At certain points between piles the beam may be formed with additional knuckles 50.

It is often found that structural damage in buildings is caused to have in the sub-soil, especially if the sub-soil comprises or includes clay. The present invention can ensure that no further structural damage occurs as a result of further heave in the clay sub-soil. To this end the ring beam and knuckles are laid on a compressible layer (for example a layer of 'clay board') which is sufficiently rigid to support the weight of the ring beam and knuckles as they are being cast but is designed, on movement of the sub-soil towards the formed ring beam and knuckles, to deform to allow the sub-soil to heave upwardly without lifting the beam with it. Of course, in such circumstances it is essential that the region of the stratum which is subject to heave and through which the piles pass should not exert upward thrust to the piles and consequently over those areas of the piles passing through such a stratum it must be provided with a relatively frictionless outer surface provided, for example, by providing a frictionless coating to the pile either by coating the pile or by passing the pile through a sleeve which is not attached to the pile and consequently can move longitudinally relative to it with the heaving sub-soil. It will be realised that in such applications the pile must be driven as near vertical as may be possible and that a compressable membrane must be provided under the existing building or its footings if they exist. This latter requirement is achieved after supporting the building on the piles of the invention and, if present, ring beams, by removing a layer of soil from beneath the structure of footings and replacing it with a compressable layer of, for example, clay board or compressable expanded polystyrene.

FIGS. 5, 6 and 7 disclose a drill assembly useful in the present invention. The drill assembly is intended to drill relatively large diameter holes, for example of 9 inch (230 mm) outside diameter, through building structures to be supported and the sub-soil therebelow by removing a core. The drilling assembly including a drill bit 10 which comprises a lower annular ring 12 fixed to an upper hollow cylindrical casing 14 attached by means of one or more drive shaft sections 16 to a drifter assembly 18 comprising one or more rotary motors 20 which rotate a drive plate 22 to which the upper end of the shaft sections 16 are attached and which is reciprocated by means of a reciprocating arrangement 24 located at the centre of the plate 22, whereby the drilling assembly is provided with a rotary percussive action. A purely rotary drilling action may also be employed.

The end face of the ring 12 is provided with a plurality of buttons 26 which are hardened steel inserts having hemispherical ends. The buttons are spaced over the width and circumference of the end face of the ring 12.

Figure 8:
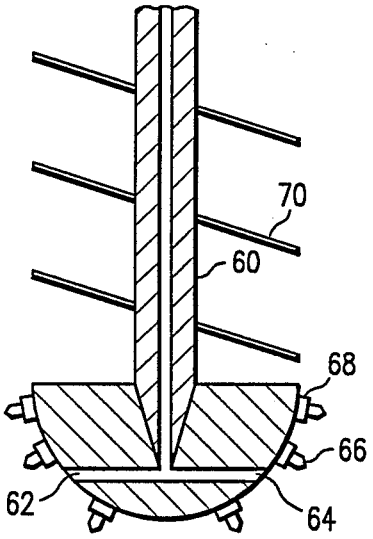
FIG. 8 shows diagrammatically a further drilling assembly.

FIG. 8 shows a further drilling assembly for forming the hole through the structure to be supported. It has a drill bit adapted for fixing on the end of the piston rod of a standard down-the-hole drilling assembly. As the drilling assembly does not form part of the present invention it is not illustrated or described in detail but its rotating and reciprocating piston rod 60 is shown in FIG. 8 connected to a drill bit 62 by a morse taper arrangement and, as is the case with most down-the-hole drilling assemblies, the drill bit, which has a domed configuration, has passages 64 extending therethrough by which operating fluid from the drill assembly may exhaust, the operating fluid serving also to flush away particles removed by the drill bit. The drill bit removes particles of masonry, concrete, rock or soil by the action of a plurality of hardened steel picks 66 removably mounted on the drill bit by any suitable pick holding means 68 at suitable angles thereto.

To remove material excavated by the picks 66 an auger flight 70 is fixed to the piston rod 60. An alternative underpinning arrangement is described with reference to FIG. 9 which shows a wall having the normal inner and outer brick courses 110, 112, separated by a cavity 114, the courses being supported on a brick foundation 116 the mortar of which can be assumed to have degraded such that at least the foundation 116 is non-rigid as compared, for example, to a normal modern concrete foundation.

The method described above the using a supplementary beam surrounding the structure is relatively expensive in certain instances, as it is necessary to manually excavate a trench around the structure in which the beam can be cast or placed.

Figure 9:
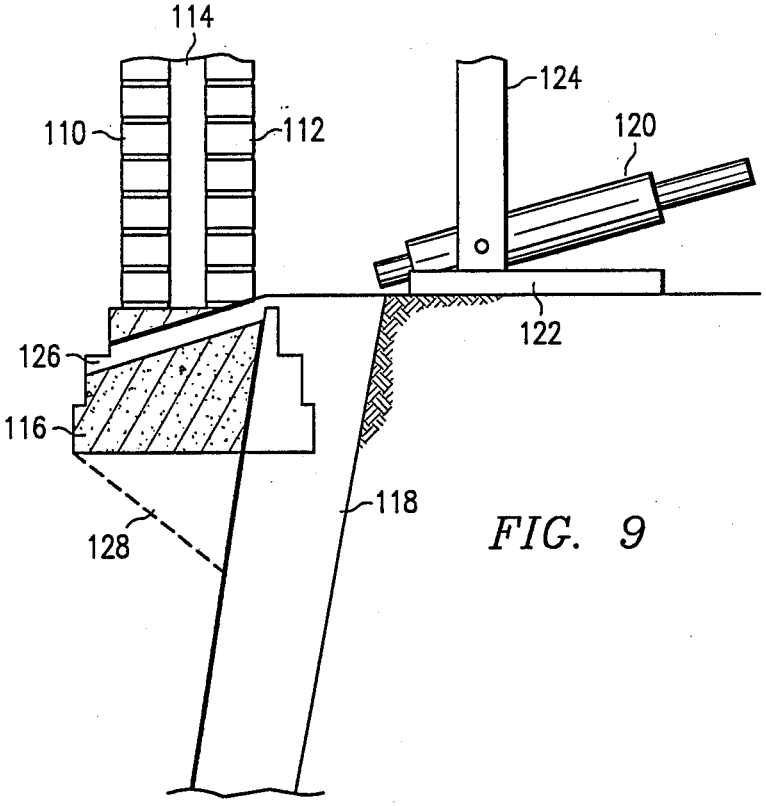
FIG. 9 shows a cross-section through the lower part of an external load bearing wall of a house.

The arrangement of FIG. 9 can be produced without this expensive step and comprises forming a large diameter hole 118 utilising the drilling method and apparatus described above. This apparatus comprises a relatively large diameter drill, for example 230 mm outside diameter, which operates by drilling through the foundation at an angle as close to the vertical as possible from ground level, by removing a core.

Having drilled the large diameter hole 118 as shown in the drawing, the drill assembly is removed from its support or alternatively moved up the support out of the drilling position so that a smaller diameter rotary percussive drill 120 may be support by the base plate 22 and upright 124 of the drill support. The small diameter drill is then utilised to drill a series of small diameter holes, only one of which, 126, is shown, through the foundation 116. Penetration may be complete or may terminate part way across the foundation.

After the first hole 126 is drilled the orientation of the drill 120 is altered and a second hole at a greater angle to the vertical is drilled this being followed by a series of further holes all on the same vertical plane so that at the end of the drilling operation a downwardly extending slot from the first hole 126 is provided through the foundation. The drill is then utilised to continue the slot such that it extends downwardly to meet the side of the hole 118 by removing a substantially triangular area of sub-soil 128.

It will be realised therefore that a hole and slot is formed in the manner of a stilt and after the introduction of reinforcement into the hole 118 and the slot, if desired, concrete is poured into the hole and slot. The concrete, after setting, forms a pile having an outstanding step formed integrally therewith which supports the previously unstable structure.

It will be realised that a plurality of such "stilt" piles are provided around the periphery of the structure to be supported at centres the spacing of which is carefully calculated to ensure complete support of the building.

Whereas this method results in a greater number of piles than the first method described above, it provides support for the structure without the need for excavation and the formation of a concrete beam. As the drilling apparatus is already on site it is readily available for increased use, and by using two support structures for every drifter assembly and rotary percussive drill a further increase in efficiency can be achieved as a rotary percussive drill can be cutting a slot from a perviously drilled hole while the drifter assembly is forming the next hole.

Various modifications of this arrangement can be made without departing from the scope of the invention. For example the reinforcing of the pile can comprise or include a central reinforcing bar from which can radiate fixing ties of the type described above.

Figure 10:
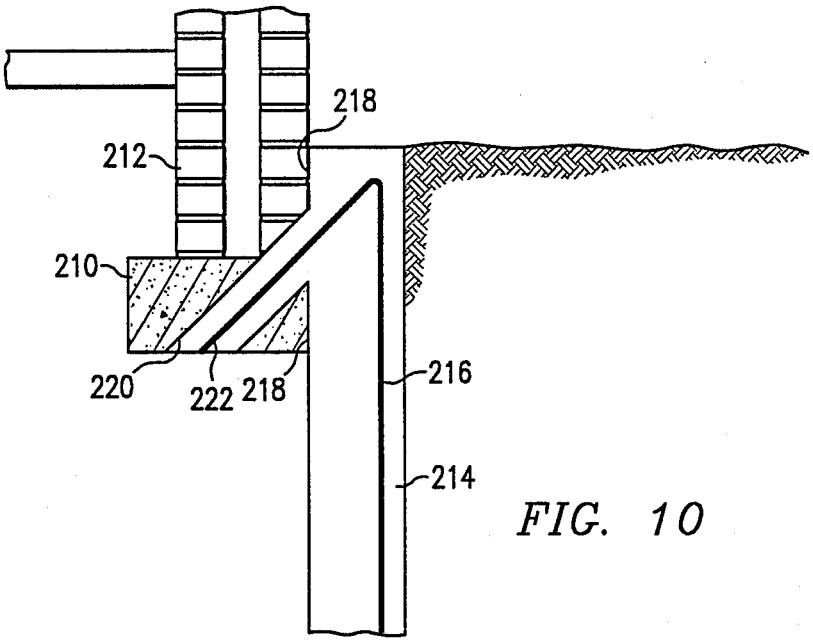
FIG. 10 shows diagrammatically a cross-section through the footings of a building structure and the top of a pile intended to underpin the structure.

In the third underpinning arrangement (FIG. 10), a pile 214 is driven alongside a structure on the outside of the building, which comprises a cast concrete footing 210 supporting a cavity brick wall 212. It will be realised that the invention would function equally well with the pile driven inside the building. It is normally more convenient to work from outside the building.

The pile 214 which may take any convenient form (but suitably is a pile of the type described above) is driven substantially vertically. In the arrangement described earlier, the drill bit of the pile driving assembly removes a segment from the structure as it descends but with the present arrangement, although this may be desirable, it is not essential. It is however essential that the top of the pile comes into side-by-side contact with the wall of the structure to be supported.

As the pile 214 shown in the drawing is a pile of the type described above it will not now be described in detail. It will be noticed, however, that it includes an off-centre reinforcing member 216 and that a top region thereof come into surface contact with the structure over the face 218.

A smaller diameter rotary percussive drill is then utilized to bore a passage 220 at an angle to the horizontal and vertical through the footing 210, the hole being centered on the line of contact of the pile with the structure. After fitment of a reinforcing rod 222 into the passage 220 and connection of the reinforcing rod 222 with the reinforcing rod 216 of the main pile cementitious grout is poured into the passage 220 to combine with the material of the pile 214 to form a continuous structure which is bonded to the footing 210.

Various modifications can be made to this arrangement without departing from the scope of the invention, for example the pile can take any convenient form. It may be a present sectional pile or it may be cased pile which is bottom driven utilizing a soil displacement method. In this latter instance the pile casing may be of plastics material provided with a forward tubular steel tip. The passage 220 need not be formed by a rotary percussive drill; any suitable passage forming technique can be employed.

In a further modification the passage 222 drilled through the structure 210 can be continued into the stratum on which the structure is supported. In this instance the reinforcing member 222 would continue into the continued hole and the grout material would be supplied to fill the entire hole.

Whilst endeavouring in the foregoing specification to draw attention to those features of the invention believed to be of particular importance it should be understood that the Applicant claims protection in respect of any patentable feature or combination of features hereinbefore referred to whether or not particular emphasis has been placed thereon.

I claim:

1. A method of underpinning a structure comprising: forming a hole in which a concrete pile may be cast, forming at least one supporting limb which extends from the pile hole and engages the structure, casting a pile in the pile hole, the pile and supporting limb being so made as to form a unitary element whereby forces exerted on the supporting limb by the structure are transmitted to and borne by the pile, forming a plurality of pile holes at spaced intervals around the structure, each having a pile with projecting ties fixed to the structure, and forming a beam fixed to the pile tops to form a ring beam around the structure.

2. A method according to claim 1 comprising providing shear pins projecting from the beam into the structure.

3. A method according to claim 1 or 2 comprising forming the beam in situ.

4. A method of underpinning a structure comprising:

forming a pile hole at an angle close to the vertical, at least part of the hole being formed through the structure, and thereafter utilizing a drilling technique to cut a slot through the structure, the slot opening out on the underisde of the structure and being formed from within said hole, and forming a pile in the hole, the pile formation including the step of providing an integral step in said slot.

5. A method according to claim 4 wherein the pile is formed by pouring concrete into the hole and slot.

6. A method according to claim 5 comprising placing reinforcement in the hole prior to the pouring of concrete.

7. A method according to claim 6 comprising extending the reinforcement to the slot.

8. A method according to claim 7 comprising fixing ties to the structure and to the reinforcement.

9. A method according to claim 8 comprising orienting the ties to radiate outwardly and downwardly from the reinforcement.

10. A method according to claim 8 or 9 comprising locating the ties in holes drilled in the structure and and fixing the ties therein by grount.

11. A method according to any one of the claims 8 to 10 wherein the ties are hooked around the reinforcing bars.

12. A method according to claim 4 comprising forming the hole by drilling assembly comprising a cylindrical drill bit open at one of its ends, said end being provided with a plurality of buttons of a material relatively harder than the material of the cylinder, the other end being connected to drive means imparting rotational and reciprocal percussive forces to the bit.

13. A method according to any of claim 4 wherein the slot is formed by a small diameter rotary percussive drill which is mounted on a structure which originally supported the hole forming drill.

14. A method of underpinning a structure comprising:

placing or forming a pile alongside the structure to be supported, with the upper regions of the pile contacting a side of the structure, drilling a downwardly extending hole into the structure at an angle to the horizontal and vertical in the region of said area of contact, locating at least one reinforcing member in said hole, connecting said member with the pile and thereafter filling the hole with cementitious material to form a supporting limb extending from the pile.

15. A method according to claim 14, wherein the pile has a diameter greater than the diameter of the hole drilled in the structure.

16. A method according to claim 14 or 15 wherein the pile hole is formed by coring.

17. A method according to claim 14 or 15 wherein the pile is formed by driving a hollow casing and thereafter filling the casing with the reinforcing members and concrete.

18. A method according to any of claims 14 or 15 wherein contact between the top of the pile and the structure to be supported is provided by removing a segment from the side of the structure, part of the pile periphery being accommodated within the space left by the removed segment.

* * * * *